US006655526B2

(12) United States Patent
Urman et al.

(10) Patent No.: US 6,655,526 B2
(45) Date of Patent: Dec. 2, 2003

(54) ENVIRO PACKAGE CONSISTING OF A SEALABLE THERMOPLASTIC BAG WITH AN INTEGRAL EXTERIOR POCKET AND HANDLE FOR HORIZONTAL TRANSPORT AND AN OPEN-DOMED RIGID PLASTIC STACKABLE CONTAINER

(76) Inventors: Craig A. Urman, 1 Alumbre, Rancho Santa Margarita, CA (US) 92688; Martin Reall, 14771 Livingston Rd., Tustin, CA (US) 92780

( * ) Notice: Subject to any disclaimer, the term of this patent is extended or adjusted under 35 U.S.C. 154(b) by 72 days.

(21) Appl. No.: 10/043,054

(22) Filed: Jan. 8, 2002

(65) Prior Publication Data

US 2003/0127462 A1 Jul. 10, 2003

(51) Int. Cl.[7] ..... B65D 85/00

(52) U.S. Cl. ..... 206/223; 206/548; 206/551; 206/770; 229/87.04; 229/87.08; 220/574

(58) Field of Search ..... 206/223, 548, 206/551, 770; 229/87.08, 87.09; 220/574

(56) References Cited

U.S. PATENT DOCUMENTS

| | | | | | |
|---|---|---|---|---|---|
| 4,361,227 | A | * | 11/1982 | Paulucci | 426/120 |
| 4,709,851 | A | * | 12/1987 | Vanasse | 229/87.09 |
| 5,232,148 | A | * | 8/1993 | Vilas-Boas | 229/87.04 |
| 5,385,292 | A | * | 1/1995 | Labianca et al. | 229/120 |
| 5,542,540 | A | * | 8/1996 | Knapp et al. | 206/525 |
| 5,565,228 | A | * | 10/1996 | Gics | 426/107 |
| 5,605,231 | A | * | 2/1997 | Borsboom et al. | 206/551 |
| 5,676,252 | A | * | 10/1997 | Lillelund et al. | 206/551 |
| 5,743,402 | A | * | 4/1998 | Gics | 206/548 |
| 6,257,434 | B1 | * | 7/2001 | Lizzio | 220/4.23 |

* cited by examiner

*Primary Examiner*—Joseph M. Moy

(57) ABSTRACT

A packaging system consisting of a sealable thermoplastic bag with an exterior pocket and integral handle fastened across the top side and an open-domed, rigid plastic, stackable container that allows for the horizontal storage and transport of food products and other goods.

19 Claims, 3 Drawing Sheets

ENVIRO PACKAGE CONSISTING OF A SEALABLE THERMOPLASTIC BAG WITH AN INTEGRAL EXTERIOR POCKET AND HANDLE FOR HORIZONTAL TRANSPORT AND AN OPEN-DOMED RIGID PLASTIC STACKABLE CONTAINER

The present invention is the continuation of provisional Patent Application 60/260,197 filed Jan. 8, 2001, the contents of which are hereby incorporated by reference.

REFERENCES CITED

| U.S. Patent Documents | | | |
|---|---|---|---|
| 5,950,912 | Sept. 1999 | Economopoulos | 229#120.32 |
| 5,882,118 | Mar. 1999 | Daniels | 383#8 |
| 5,573,489 | Nov. 1996 | Letendre | 493#194 |
| 5,351,880 | Oct. 1994 | Goudreau | 229#120.32 |
| 5,002,221 | Mar. 1991 | Ragan | 229#120.32 |
| 4,951,866 | Aug. 1990 | Rusnak | 229#120.07 |
| 4,913,693 | Apr. 1990 | Ball | 493#194 |
| 4,241,863 | Dec. 1980 | Faller | 229#120.03 |
| 4,061,241 | Dec. 3977 | Retelny | 220#4.21 |
| 3,744,383 | July 1973 | Finch | 93#35R |

FIELD OF THE INVENTION

The present invention relates to a transportable packaging system for products that are best carried in a horizontal position and that require spaced, noncrushable stacking. It is useful in the food industry as packaging for pizza, heated fast-food items, salads, deli products, and bakery goods. This packaging system has additional uses outside the food industry, for example as light-weight, cost-effective packaging for crushable arts and crafts, floral wreaths, toys, and any other products that are best kept in a horizontal position during storage and transport and that need to be stacked apart without crushing. This invention is potentially reusable, and thus environmentally friendly.

BACKGROUND OF THE INVENTION

Consumer packaging has customarily taken the form of paper wraps or fold-up paper bags, which vary in thickness, density, color, size and other features, but all of which have been produced at significant cost to the environment in terms of the raw materials required to make packaging. In the past several decades, plastic packaging has largely taken the place of paper wraps and bags in consumer markets.

Paper and plastic packaging for consumers have had significant drawbacks. First, these types of packaging are top-loaded and, if handles are provided, said handles are positioned in such a manner that the package must be carried vertically instead of horizontally. While goods requiring horizontal transport can be placed on the bottom of a top-loaded bag and then carried vertically, this system is not satisfactory for the following reasons. For goods that are larger in horizontal size than the bottom of the vertical packaging, the items could be crushed when the bag sides press inwards during transport. Also, the placement of such an item into a vertical bag, as well as later extrication, is difficult. Even if goods that need to be carried horizontally could fit into the bottom of a vertical bag, they would not be secure and could tip over when separated from the consumer's controlling grasp by the length of the bag. If the packaging lacks handles, then the consumer will usually find transport even more difficult, often requiring two hands or a carrying position that crushes the package and its contents between arm and body.

Second, existing paper and plastic packaging for consumers often requires some labor to prepare the packaging for use, which increases the cost of the packaging for the merchant. Boxes require folding, trays need to be pre-assembled, and bags need to be attached to dispensers.

Third, existing paper and plastic packaging have not made provision for an integral system that offers both separate stacking plus easy horizontal transport. While prior art for various stackable packaging exists, these systems have not developed a means for quick, one-handed transport of the package in a protective, enclosing bag. Available bags, whether paper or plastic, do not provide a means by which the contents can be stacked without crushing.

Finally, packaging generally has no further use to the consumer after the goods are transported to the intended destination. It is simply thrown away, adding to our society's already overflowing trash problem.

There is a need for a packaging system that allows for easy horizontal transport of consumer goods in combination with separate stacking so that the goods are not crushed during storage or transport and that is pre-assembled, cost-effective to produce, requires minimal storage space for the merchant, and is environmentally friendly.

Description of Related Art (including information disclosed under 37 C.F.R. 1.97 and 37 C.F.R. 1.98)

A search of the prior art did not disclose any patents that read directly on the claims of the instant invention. However, the following U.S. patents are considered relevant:

1. The U.S. Pat. No. 5,950,912 Economopoulos Patent discloses a cardboard box for stacking two pizzas in one box.
2. The U.S. Pat. No. 5,882,118 Daniels Patent discloses a gusseted T-shirt type plastic bag and method of making such bag with a promotional strip extending along one side edge and secured at the top and bottom edges of the bag.
3. The U.S. Pat. No. 5,573,489 Letendre Patent discloses a thermoplastic bag and method for making bags with loop handles at the bag top.
4. The U.S. Pat. No. 5,351,880 Goudreau Patent also discloses a corrugated box for containing two or more stacked food products.
5. The U.S. Pat. No. 4,913,693 Ball Patent discloses a method of manufacturing a gusseted bag that has an integral handle for carrying on the bag on its side.
6. The U.S. Pat. No. 4,241,863 Faller Patent discloses a paperboard container with two open-top trays hinged together, each covered by a film to secure the food within. The entire container may be placed in a cover sleeve.
7. The U.S. Pat. No. 4,061,241 Retelny Patent discloses a food plate packaging with a bottom plate that fits into a ribbed top cover that can support other similar plates when stacked on each other.
8. The U.S. Pat. No. 3,744,383 Finch Patent discloses an apparatus and method for manufacturing plastic bags with a promotional band in a single stage process.
9. The U.S. Pat. No. 1,257,057 White Patent discloses a pie container with a cover and a loop or yoke and clip for attaching and holding a fork to the container.

For background purposes and as indicative of the art to which the invention is related reference may be made to the other cited patents.

BRIEF SUMMARY OF THE INVENTION

The present invention consists of a transportable packaging system by which food and other products can be stored and transported in a horizontal position. The packaging system is comprised of two parts: 1) a thermoplastic sealable bag with a front-loading opening and integral exterior handle for horizontal transport; and 2) a rigid plastic stackable open-domed container that is inserted into the carrying bag for holding and storing food items and other products.

The bag is made of a flexible thermoplastic material, such as low or high density polyethylene, that may have a heat tolerance of up to 200° F. for up to 60 minutes. The preferred shape of the bag is square or rectangle with sides from 5 to 24 inches, although it may also be circular, made with rounded edges, or otherwise. Depending on the density of the plastic, the bag is transparent or opaque. It has three closed sides formed by folding, heat-sealing, sidewelds, or other means, and is open at the front. A small flap extends at the front with a means of closing the front side to keep the products secure inside, such as an adhesive strip, a pressure grip, or other similar device. The bag may have an exterior pocket extending 2 to 6 inches from the front opening of the bag and sealed into the side seams at the same time as the seams are made, which pocket is sliced so as to form a handle of 0.5 to 5 inches in width across the approximate center of the bag. It is possible to eliminate the exterior pocket, in which event a handle is sealed into the bag side seams at the approximate center of the bag. The bag optionally has ventilation slits or holes, and it can also be printed with logos, names, coupons, or other advertising as desired.

The rigid container is made of transparent rigid plastic material and is comprised of a bottom plate and a domed cover with an open aperture. The domed cover is optionally attached to the bottom plate by a single integral hinge at the back side of the plate or is press fitted over a flange in the rim of the bottom plate to form a gripping connection. The base plate may be flat without any ridges or may optionally have ridges rising up into the container so that products placed in the container will rest on these ridges above the flat bottom. Use of ridges depends on whether a product will benefit from air circulation underneath it, such as is often in the transport of food products, for such purposes as letting grease run off and avoiding sogginess from unvented condensation. The aperture in the domed cover and the circular bottom of the base plate will be specifically sized to allow for stacking two or more containers with the base plate of the upper container setting into the aperture of the lower container by 0.25 to 0.50 inches.

A product, such as a food item, is placed into the rigid container, which is then closed and inserted into the front-loading opening of the bag while still in a horizontal position. The entire package can then be transported or stacked on another bagged rigid container while keeping it in the same horizontal position. The bags are thin and do not interfere with the stacking of the encased rigid containers. At the same time, the bags serve as a hot vapor thermal barrier for contents that are heated and protect the contents from contamination.

One of the primary improvements made by this invention is the front-loading opening of the bag, which allows a product placed in the rigid container to be inserted while being held in a horizontal position, avoiding the difficulties of inserting a horizontally held product into a top-loading, vertically oriented bag. The position and strength of the handle allows a product to be carried in a horizontal position easily with one hand, avoiding the problem of displacing, crushing, breaking, spilling, or otherwise adversely affecting the product during transport, which often happens if it is carried in a vertically oriented bag.

The aperture in the cover allows a heated product to release vapor if transported while hot or an unheated or refrigerated item to breathe, thereby reducing the negative affects of condensation, such as sogginess. This aspect of the invention is further improved by the optional addition of ventilation slits or holes in the thermoplastic bag. The size of the aperture is specifically fixed to correspond with the base of the rigid container so that more than one package can be stacked securely on top of another one. The aperture also improves visibility of the product, which the consumer can easily see through the transparent or nearly transparent bag and the rigid container without having to open the packaging to check the contents. This function has the advantage of allowing the consumer to make certain that the contents are all that the consumer expects to purchase without having to open the sealed packaging and risk airborne or other contaminants affecting the contents.

This invention is also cost-efficient in terms of raw materials, storage of packaging, and assembly labor. There is no folding, package preparation, or other assembly required, as a product is simply placed into the container, which in turn is inserted into the bag. If desired, a merchant can add items into the external pocket, such as coupons, condiments, utensils, napkins, advertising leaflets, and the like, obviating the need for an additional bag for such extra items. The bags lie flat and are of thin plastic, allowing many to be stacked, boxed, or rolled within a small area. The rigid containers, also of thin plastic, can be inter-stacked with units of the same size. Plastics are available and inexpensive raw materials and can be molded and formed cheaply and quickly. The discarded packaging is 100% recyclable.

The invention is also capable of being reused by the consumer. Both the bags and the rigid containers are made of materials that are heat tolerant and FDA approved, and so both can be used to store food together or individually. The bag can additional by used for reheating food items. This feature enhances the economic value and utility of this invention by offering space-saving storage and eliminating the need for the consumer to use additional heating or storage bags, pans, bins, containers and so forth. The materials are also of high and lasting quality such that a consumer can reuse the packaging to transport in a horizontal position anything that fits within the bag and is within the weight tolerance of the materials. The containers also stack securely, and therefore make excellent trays for organizing items, whether left-over food, sewing items, or craft items, or otherwise. As such, the packaging is friendly to the environment because it can be recycled into various uses by the consumer.

BRIEF DESCRIPTION OF THE DRAWINGS

The invention will now be described, by way of example only, with reference to the accompanying drawings, as follows.

DETAILED DESCRIPTION OF THE INVENTION

Figure 1:
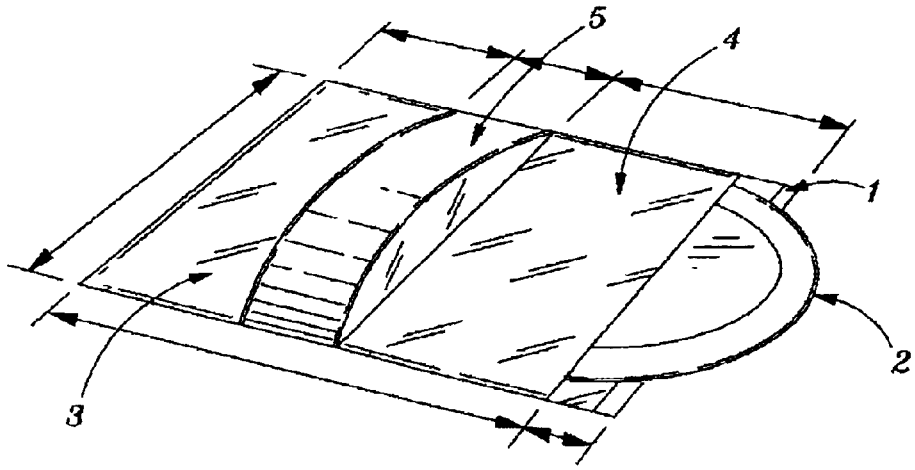
FIG. 1. Angle view of transportable packaging system showing insertion of the rigid domed container into the thermoplastic bag.

FIG. 1 shows the entire invention from an angled top view. The rigid plastic container (2) is inserted halfway into the sideweld thermoplastic bag (3). The drawing also shows the exterior pocket (4), the handle (5), and the adhesive strip (1) for closing the front-loading opening. The dimensions shown in the Figure are illustrative only, and so are the use and placement of the adhesive strip. The bag may have sideweld seams, folds, or other means of securing the edges.

Figure 2:
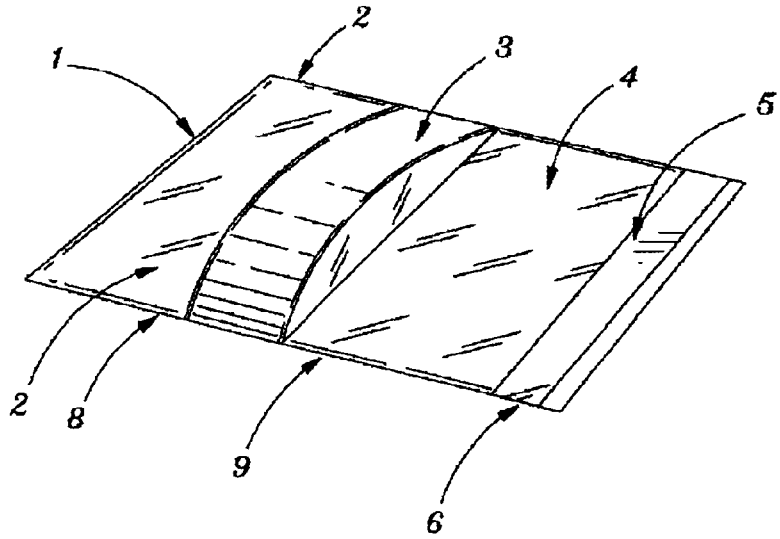
FIG. 2. Angle top view of thermoplastic bag.

Referring to FIG. 2, this shows the thermoplastic bag from an angled top view. The plastic is folded or seamed by heat-sealing the edges (1) and (2). It has a handle (3), which lies flat across the approximate center of the bag and is slightly raised in the figure for visibility purposes; and external pocket (4) between the handle and the front-loading opening created by folding the plastic back into a third layer (5); an extended flap for closure with an adhesive strip for closure of the flap (6). Use and placement of the adhesive strip is optional, and the bag edges may be folded, heat-sealed, or otherwise seamed.

Figure 3:
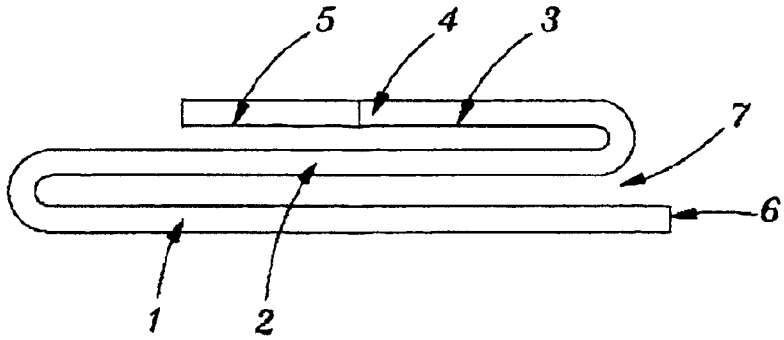
FIG. 3. Side cut-away view of thermoplastic bag showing three-layered construction.

FIG. 3 is a side cut-away view of the thermoplastic bag showing its three-layered construction. The bottom layer (1) forms the bottom side of the bag; the second layer (2) forms the top side of the bag; and the third layer forms the exterior pocket (3), which is slit (4) to form the handle of the bag (5). The bottom layer (1) extends beyond the second layer (2) to create a flap (6) that can be folded back or otherwise used to close the front-loading opening (7).

Figure 4:
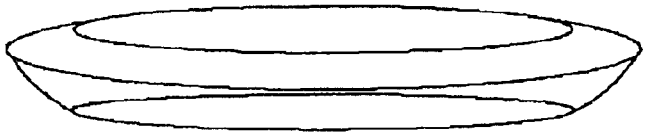
FIG. 4. Side view of rigid plastic container showing dome top, aperture, and base.

In FIG. 4, the domed rigid plastic container is seen from the side. The plastic is transparent, and therefore it is possible to see (1) the base of the bottom plate with curved sides; (2) the domed cover with a curved rim; and (3) the aperture in the domed cover.

Figure 5:
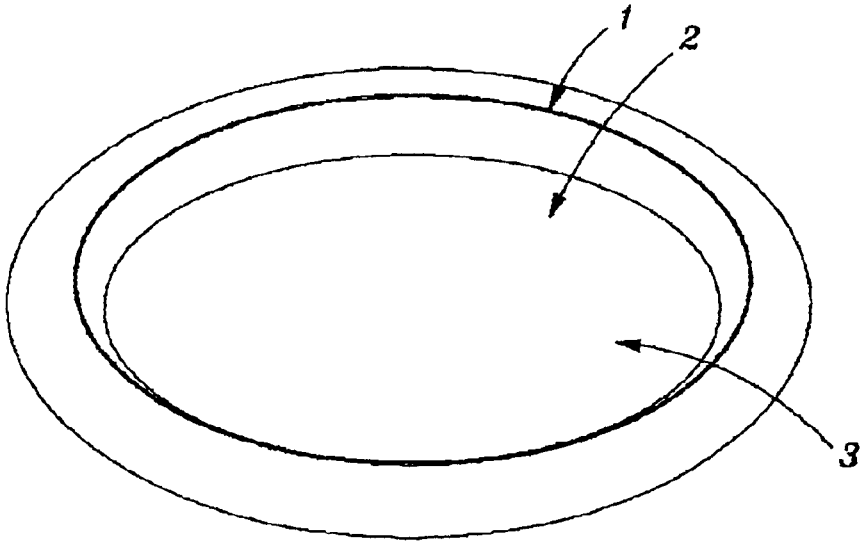
FIG. 5. Angled top view of rigid plastic container.

FIG. 5 shows the rigid plastic container from an angled top view. This drawing shows the domed cover with the aperture (1); the base plate (2); and the interior of the container where the product would be placed (3). The base plate is shown in a smooth form; ridges of various shapes, sizes, and heights rising into the interior of the plate are optional.

Figure 6:
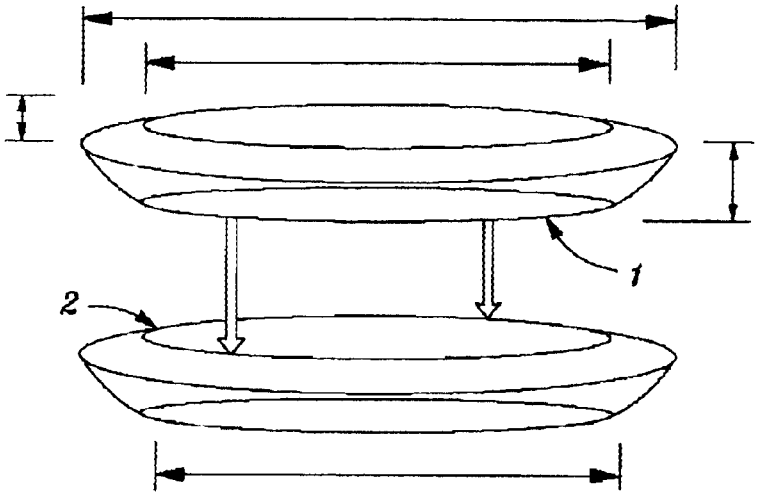
FIG. 6. Side view of two rigid plastic containers being stacked together. Containers can be stacked in this manner while encased in the thermoplastic bag, but the bag has been eliminated from the drawing so as to show the stacking function more clearly.

The stacking function of the rigid containers is illustrated in FIG. 6. This Figure shows side views of two of the rigid containers as were illustrated in FIG. 4. The dimensions given are illustrative examples only. The dimensions show clearly that the base of the rigid container (1) is smaller in diameter than the aperture of the top cover (2) by approximately 0.25 inches. This change in diameter allows an upper container to be set into a container beneath it, and this arrangement can be made even when the container is encased in the thermoplastic bag, which is less than 1.5 millimeters thick and therefore will not interfere with the stacking.

Figure 7:
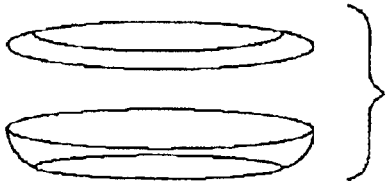
FIG. 7. Side view of rigid plastic container with optional separate top and base to be closed by snapping the top onto the base.
Figure 8A:
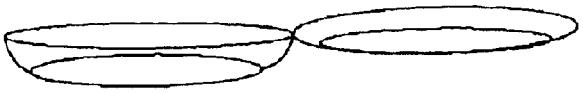
FIG. 8. Top view of rigid plastic container with optional hinge connecting top and base.
Figure 8B:
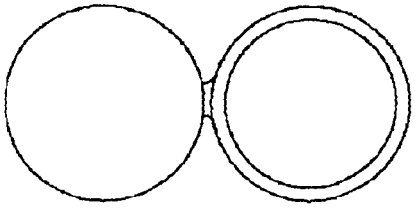

In both FIG. 6 and FIG. 7, two optional closure methods are demonstrated for the rigid plastic container. FIG. 6 shows a side view of the rigid container when it is designed for a snap-on closure. This drawing shows the domed top of the container being larger in circumference than the base plate, allowing the top to be set over and connect with the bottom plate. In FIG. 7, the container is hinged and is shown from two views. The side view shows the top open from the base and resting back on its hinge. The top view shows the top and base plate open with the hinge connecting them. In this view, it can be seen that the top and base are one piece connected with the hinge. This is illustrative only, as it is also possible to have a hinge applied to the top and base as a separate piece.

We claim:

1. A transportable packaging system of plastic material for the horizontal storage and transport of food and other products, comprising:

(a) a rigid container comprised of a rigid plastic bottom plate with a domed cover, optionally attached to each other; wherein the cover has curved sides and a center aperture and the bottom plate has curved sides and a base that has a diameter that is smaller than the diameter of the center aperture in the top by no more than 0.5 inch, (b) a thermoplastic bag square or rectangular in shape with sides of about 5 inches to about 24 inches in length and width, and comprised of three attached layers, the first and second layers forming the bottom and top sides of the bag, and the third layer forming an exterior pocket on the top of the bag with a slice in it at from 1 to 3 inches from the layer edge to form the pocket and an adjacent separate handle crossing the top side of the bag approximately at the center.

2. The package of claim 1 wherein the rigid container is circular or pie-shaped of a diameter that is capable of fitting inside the thermoplastic bag.

3. The package of claim 1 wherein the rigid container is a shape other than circular that is capable of fitting inside the thermoplastic bag.

4. The package of claim 1 wherein the bag is comprised of thermoplastic material that has a heat tolerance of up to 200° F. for up to 60 minutes.

5. The package of claim 1 wherein the bag is comprised of thermoplastic material such as high-density or low-density polyethylene.

6. The package of claim 1 wherein the rigid plate is formed of plastic resin.

7. The package of claim 1 wherein the bag and plate are comprised of FDA-approved materials for safe storage of food.

8. The package of claim 1 wherein the bag handle is from about 0.50 to 5 inches wide.

9. The package of claim 1 wherein the thermoplastic bag has one or more slits, holes, or other small openings for ventilation.

10. The package of claim 1 wherein the bottom layer of the bag extends to ½ inches to 3 inches longer than the top layer at the open seam to allow for folding over when closing the bag.

11. The package of claim 1 wherein the thermoplastic bag is comprised of plastic layers each of which is approximately 0.25 to 1.5 millimeters in thickness.

12. The package of claim 1 wherein the thermoplastic bag has no exterior pocket.

13. The package of claim 1 wherein the thermoplastic bag incorporates suitable sealing fasteners at the open seam, such as an adhesive, interlocking, or pressure strip by which the bag can be opened and resealed.

14. The package of claim 1 wherein the thermoplastic bag weight tolerance is at least around 5 to 6 pounds.

15. The package of claim 1 wherein the rigid container is a single integral plastic container hinged to open like a clam-shell.

16. The package of claim 1 wherein the rigid container has a separate, unattached top cover and base with the base being sufficiently smaller than the top to close under it.

17. The package of claim 1 wherein the rigid container has a smooth base.

18. The package of claim 1 wherein the rigid container has ridges in the base, which ridges may be in the form of parallel or concentric lines or other shapes that rise into the interior by no more than 0.75 inch.

19. A process to form the bag of claim 1 wherein the layers of the bag are cut from sheet plastic, then heat-sealed together at the seams, leaving at least one seam open (unsealed) to allow for insertion of contents, and optionally including a gusset at one or more of the seams.

* * * * *